United States Patent [19]

Trongo

[11] 4,106,373

[45] Aug. 15, 1978

[54] BIT DRIVING TOOL FOR USE IN BARRIERS SEPARATING DIFFERENT ENVIRONMENTS

[76] Inventor: George Trongo, 2974 Flannery Rd., San Pablo, Calif. 94806

[21] Appl. No.: 806,619

[22] Filed: Jun. 15, 1977

[51] Int. Cl.[2] ..... B25B 23/00

[52] U.S. Cl. ..... 81/180 R; 145/50 B

[58] Field of Search ..... 29/240; 81/180 R, 180 C; 145/50 A, 50 B, 50 C

[56] References Cited

U.S. PATENT DOCUMENTS

| | | | |
|---|---|---|---|
| 1,579,818 | 4/1926 | Kennedy | 145/50 C X |
| 3,046,645 | 7/1962 | Smith | 29/240 |
| 3,208,133 | 9/1965 | Morton | 29/240 X |
| 3,623,206 | 11/1971 | Hager | 29/240 |
| 3,840,967 | 10/1974 | Olson | 29/240 X |

*Primary Examiner*—James L. Jones, Jr.
*Assistant Examiner*—James G. Smith
*Attorney, Agent, or Firm*—Thomas Schneck

[57] ABSTRACT

A bit driving tool useful for adjusting obstructed or inaccessible bolts, screws or nuts. The tool is placed in a broach hole formed through a barrier or obstruction and a set of sleeves coaxially surrounding a tool shaft both aligns the tool bit with the screw or nut and seals the broach hole against leakage.

5 Claims, 3 Drawing Figures

BIT DRIVING TOOL FOR USE IN BARRIERS SEPARATING DIFFERENT ENVIRONMENTS

BACKGROUND OF THE INVENTION

A. Field of the Invention

This invention relates to screw, nut and bolt adjustment tools, namely to screw and nut drivers. More particularly the invention relates to a tool that guides emplacement of the tool bit and allows the driving and driver ends of the tool to be used between different environments.

B. Prior Art

A problem in the prior art is how to adjust screws, bolts, nuts and the like, placed in hard to reach and sometimes totally inaccessible or invisible regions of a machine or other manufactures.

Oftentimes access to a screw, bolt or nut is blocked by a cover, wall, projection or other barrier. One solution to this problem is to provide a broaching hole in the barrier, and to insert the driving tool, such as a screwdriver, through the hole. This solution has several disadvantages, one of them being the difficulty of engaging the tool bit with the object, such as a screw head, when neither the bit nor the object can be seen.

A second problem is how to adjust an object, such as a screw, which is enclosed or encapsulated against the ambient environment, with different environmental conditions, e.g., pressure, inside and outside of the enclosre. A simple broach hole would be an unacceptable solution to this problem of access, for such a hole would vent the enclosed region to the ambient environment.

It is an object of this invention to provide a tool for guiding tool bits into contact with an object to be driven.

It is a further object of this invention to provide a tool for driving bits to be used in barriers separating different environments.

SUMMARY OF THE INVENTION

The above objects have been realized in a tool having a shaft which is slideable and rotatable within a shaft guide hole of a broach sleeve which coaxially surrounds the shaft. The broach sleeve serves a dual function. First, when attached to a barrier broach hole, it seals the hole against leakage. Second, it provides for the accurate guidance of the shaft and a connected bit to the object to be driven, e.g. a screw or nut.

The broach sleeve may be attached to the barrier broach hole by threading an external portion of the sleeve so that it may engage mating threads provided in the barrier broach hole. Sealing material may also be utilized to make the shaft guide hole leakage resistant between the interior of the broach sleeve and the shaft. A compression sleeve radially expands sealing material between the shaft and broach sleeve interior wall. The shaft may be provided with a knob or handle at its driving end to facilitate shaft manipulation. A bit at the driver end of the shaft may be any known screwdriver, nut driver, socket or other bit, including drill bits and the like.

DESCRIPTION OF THE PREFERRED EMBODIMENT

Figure 1:
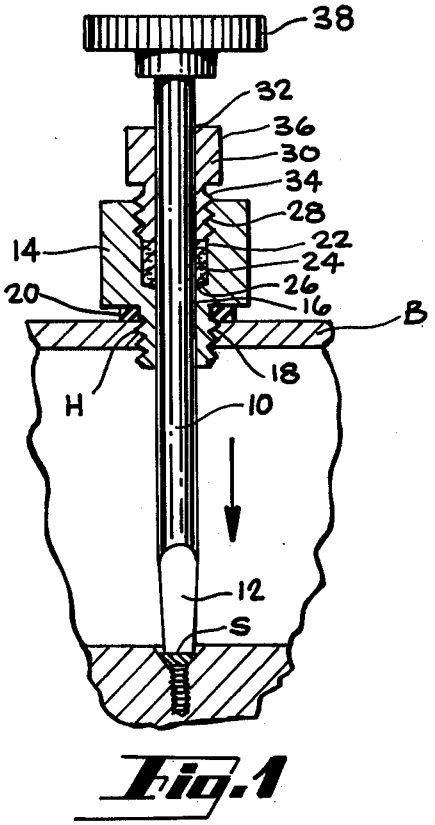
FIG. 1 is a side cutaway view of the preferred embodiment of the present invention in a retracted position.

FIG. 1 shows the tool of the present invention with a shaft 10 and an object engagement bit 12. Shaft 10 is typically of circular cross section, and is usually metal in construction, although it may be made of other materials, such as plastic.

Object engagement bit 12 is shown here to be a screwdriver bit. This invention, however, does not limit itself to screw engagement bits. Other bits such as nut driver, socket and drill bits may be used, depending upon the type of object under adjustment, or in the case of a drill bit, the type hole to be made. Engagement bit 12 is also typically of metal construction, but may be of other materials.

In the present invention, shaft 10 and engagement bit 12 are shown as one piece. Alternate embodiments may have bits that are attached to shaft 10, either permanently or removably.

Broach sleeve 14 is an elongated, tubular structure having an internal shaft guide hole 16 defined axially between its ends. The sleeve slips over shaft 10. The fit of shaft 10 in shaft guide hole 16 is with a slight clearance and not binding so that shaft motion is easy, but not loose. About 0.002 to 0.005 inches clearance is adequate. Broach sleeve 14 and shaft 10 are both mutually slideable and rotatable.

In the present invention, broach sleeve 14 is attached to barrier B, a wall separating two areas or separating two environments, by means of externally threaded portion 18 engaging with mating threads in barrier broach hole H. Broach sleeve 14 is then rotated until washer 20 produces a fluid tight seal between the unthreaded portions of broach sleeve 14 and barrier B. Washer 20 may not be necessary in some applications. Other means of attachment of broach sleeve 14 such as push-and-twist or press-fit are deemed to be equivalent structures, as long as hole H is sealed.

Broach sleeve 14 is provided with an internal annular recess 22 for sealing material 24. Sealing material 24 performs the function of sealing shaft 10 against shaft guide hole 16, yet permitting rotation and translation of the shaft. Sealing is necessary if a pressure differential between the two sides of barrier B exists or if environmental conditions are otherwise different and to be preserved. Sealing material 24 is made of a material for keeping the two environments separate. For example, if one environment is air at ambient pressure and the other environment is air at a few pounds lower pressure, valve stem packing is an acceptable sealant. Valve stem packing is typically an asbestos-graphite compound disposed on string. Teflon O-rings or other sealing materials may also be utilized as long as rotation and translation of the shaft 10 is preserved when the sealing material is under compression.

The terminal portion of recess 22 is tapered region 26 which urges sealing material 24 against shaft 10 when compressional pressure is applied.

Internally threaded portion 28 of broach sleeve 14 near recess 22 begins near an end of broach sleeve 14. Threaded portion 28 does not extend into the region where sealing material 24 resides.

Compression sleeve 30 comprises shaft hole 32, externally threaded portion 34 and bolt head 36. Generally, compression sleeve 30 is metal in construction, but other materials may be used and are contemplated.

Compression sleeve 30 slides over shaft 10 so that threaded portion 34 of compression sleeve 30 is able to engage with mating threads in internally threaded portion 28 of recess 22. Shaft 10 and compression sleeve 30 are mutually slideable and rotatable.

Compression sleeve 30 is screwed into recess 22 by means of a tightening force being applied to bolt head 36. This provides compressing pressure on sealing material 24 sufficient to inhibit fluid leaking between environments on opposite sides of the barrier, yet allow translation and rotation of shaft with enough friction so that the shaft remains in place against gravity when mounted in a vertical position yet translates downward with a force of two or three ounces when pushed.

Alternate embodiments of this invention may utilize other means for applying a tightening force to compression sleeve 30, such as a knurled head or tightening pin or the like.

The figure shows a driving end of shaft 10 being provided with knob 38. Knob 38 aids in the manipulation of the shaft 10 by providing a sturdy and controllable grip. Alternate grips may be provided.

The outer surfaces of knob 38 and broach sleeve 14 may be knurled to provide a better grip. Other grip enhancing schemes have been contemplated for alternate embodiments, such as grooved slots or rubber covers.

Figure 2:
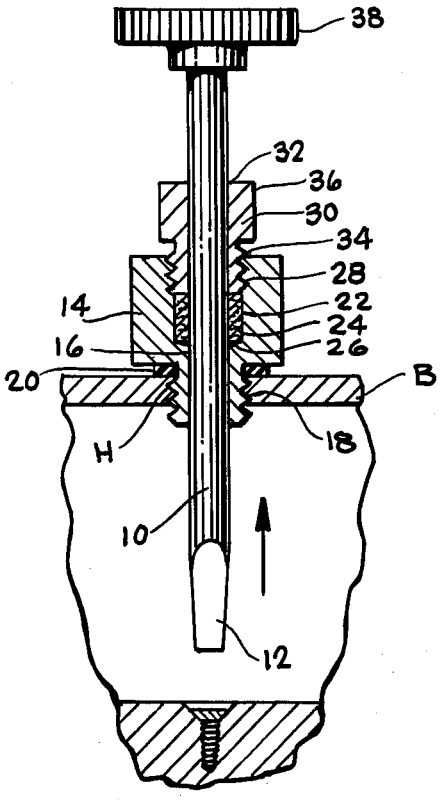
FIG. 2 is a side cutaway view of the apparatus of FIG. 1 in an object engagement position.

A typical use for the tool of the present invention would be to adjust the idle set screw on a PT Cummins fuel pump where the idle set screw is situated behind an air-tight cover and is kept under partial vacuum. The tool is adapted with a screw driver bit and the tool shaft advanced to make an adjustment and retracted when not in use, as shown in FIG. 2.

A user provides threads in a broach hole H directly opposite set screw S. The user then screws threaded portion 18 of broach sleeve 14 into broach hole H until tight. Pressure and a slight torque applied to knob 38 urges screw engagement bit 12 to set screw S. Shaft guide holes 16 and 32 insure proper alignment of screw engagement bit 12 and set screw S.

When screw engagement bit 12 and the head of screw S are engaged, torque may be applied to knob 38 to adjust screw S. Washer 20 and sealing material 24 greatly reduce any leakage between the ambient environment and the environment surrounding screw S.

Figure 3:
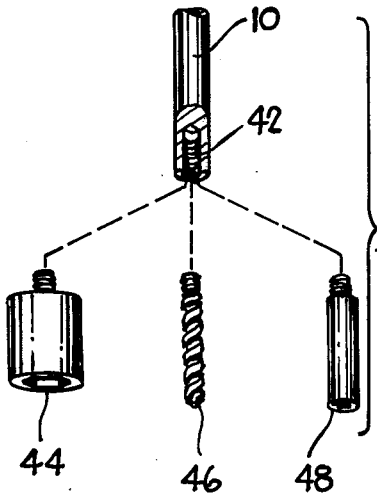
FIG. 3 is a side view of various bits to be used with the tool of the present invention.

The present invention has been described with respect to a screwdriver bit 12 which is an integral part of shaft 10. However, shaft 10 may have detachable bits, as in FIG. 3, so long as the means for attaching bits does not increase the diameter of the shaft 10. For example, shaft 10 could be truncated at an end with a small hole 42 tapped into the center of the shaft to receive a bit. Before any bit is attached, the compression sleeve 30 and the broach sleeve 14 are passed over the shaft 10. Then a selected bit, which may have a diameter greater than shaft 10 is screwed into the small hole in the center of the shaft. Thus, the diameter of the shaft has not been increased, thereby permitting the compression sleeve and the broach sleeve to pass over the shaft, yet the shaft may accommodate a bit having a cross section which is larger than the shaft diameter dimension, such as socket 44, as well as drill bit 46 or nut driver bit 48.

What is claimed is:

1. A self-supporting tool for removable use in broach holes of barriers separating different environments comprising, an elongated sleeve having first and second spaced apart ends defining a shaft guide hole therethrough with an annular recess in said sleeve, said first sleeve end having a means of removable attachment to a barrier broach hole, a shaft having a driving and a driven end, said shaft being positioned through the shaft guide hole in a slidable, rotatable relation therewith, said shaft having a length greater than the length of said sleeve for operating in said broach hole beyond said sleeve, sealing material disposed in said annular recess of said sleeve for sealing said shaft guide hole between said shaft and said sleeve.

2. The apparatus of claim 1 wherein the second sleeve end is movably mounted with respect to said first sleeve end for exerting a compressive force on said sealing material.

3. The apparatus of claim 1 wherein said sealing material is valve stem packing.

4. The apparatus of claim 1 wherein said annular recess is between the first and second ends of said sleeve.

5. The apparatus of claim 4 wherein the second sleeve end may be screwed with respect to the first sleeve end so that compressive force is communicated to said annular recess.

* * * * *